United States Patent [19]

Buck et al.

[11] Patent Number: 4,758,056

[45] Date of Patent: Jul. 19, 1988

[54] CABINET AND METHOD FOR MAKING

[76] Inventors: Ken D. Buck, N. 11516 King Arthur Dr., Spokane, Wash. 99218; Steven C. Corey, N. 15518 Myrtle, Mead, Wash. 99021

[21] Appl. No.: 13,967

[22] Filed: Feb. 12, 1987

[51] Int. Cl.[4] ..... A47B 43/00

[52] U.S. Cl. ..... 312/263; 312/245; 312/257 R

[58] Field of Search ..... 312/263, 245, 280, 257 R, 312/257 SK, 257 A

[56] References Cited

U.S. PATENT DOCUMENTS

| | | | |
|---|---|---|---|
| 2,769,679 | 11/1956 | Wiseman | 312/263 |
| 2,966,385 | 12/1960 | Murphy et al. . | |
| 3,021,187 | 2/1962 | Mitchell | 312/263 |
| 3,033,507 | 5/1962 | Brill . | |
| 3,301,622 | 1/1967 | Dasovic et al. | 312/245 |
| 3,379,483 | 4/1968 | Oldford | 312/263 |
| 3,713,718 | 1/1973 | Lucci | 312/263 |
| 3,743,373 | 7/1973 | Camper et al. . | |
| 3,765,740 | 10/1973 | Mastrangelo | 312/263 |
| 3,844,634 | 10/1974 | Kruger et al. | 312/257 R |
| 4,076,350 | 2/1978 | Crist | 312/245 |
| 4,378,137 | 3/1983 | Gibson et al. | 312/263 |

FOREIGN PATENT DOCUMENTS 1314786 4/1963 France .

*Primary Examiner*—Victor N. Sakran

*Attorney, Agent, or Firm*—Wells, St. John & Roberts

[57] ABSTRACT

A storage cabinet, and method of constructing such cabinets, having a front facing which simulates the dimensions and appearance of a separately manufactured face frame is disclosed. The front facing comprises built-up strips which project outwardly beyond the exterior surfaces of vertical side panels of the cabinet, thereby providing space between adjacent similarly constructed cabinets. The resulting space facilitates installation. The method for constructing such cabinets involves production of panels from a common sheet, the panels being usable as vertical and horizontal members of a basic box-like structure.

21 Claims, 4 Drawing Sheets

FIG 1
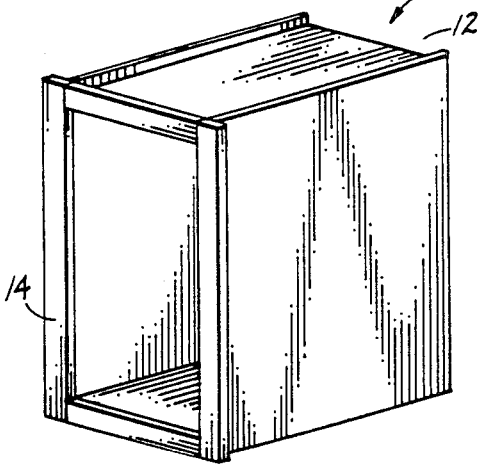
PRIOR ART
FIG 2
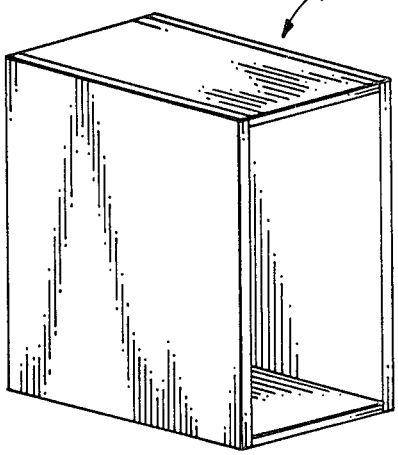
PRIOR ART
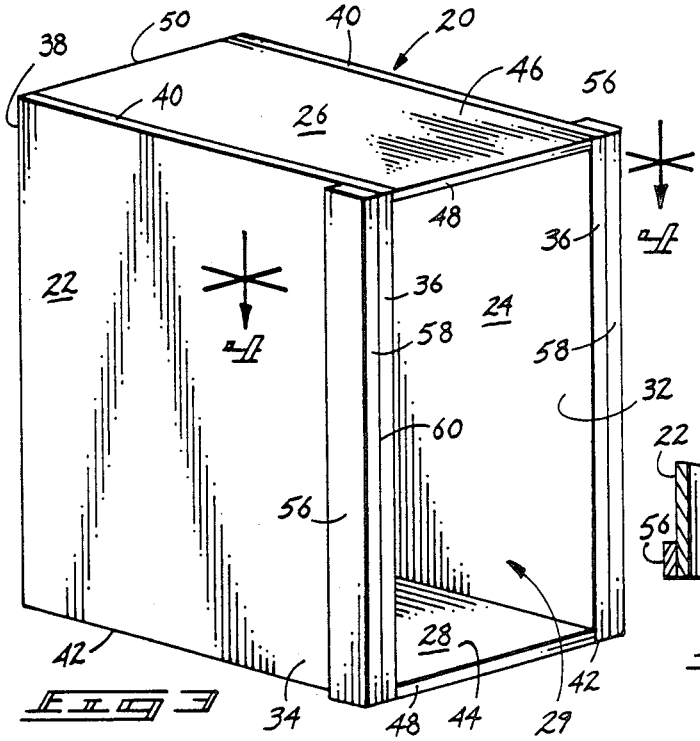
FIG 3
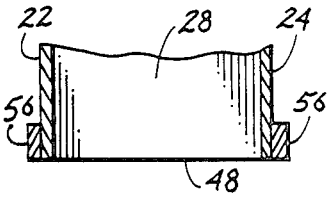
FIG 4

CABINET AND METHOD FOR MAKING

TECHNICAL FIELD

This invention relates generally to storage cabinets and methods for constructing storage cabinets.

BACKGROUND OF THE INVENTION

Storage cabinets, such as might be installed in a household kitchen, are commonly of two types, one being referred to as a European style cabinet, the other being referred to as a traditional U.S. cabinet.

The traditional U.S. cabinet structure is comprised of a rectangular box-like structure and a separately constructed face frame. After construction of the rectangular box-like structure, the face frame is secured to the box. A cabinet door is generally installed by hinges secured to the face frame. The side and top edges of the face frame typically project slightly beyond the side and top edges of the box. This provides an installer with extra room to fit the box on a wall or ceiling, with the face frames of adjacent cabinets abutting one another to present a precise appearance from the exterior of the cabinets. This providing of extra room between adjacent cabinets is desirable since conventional walls, floors, and ceilings to which the cabinets are installed are generally not constructed in a precisely square fashion. The extra room between boxes provided by the extending face frame enables the installer to accommodate irregularities in the surfaces against which the cabinets are being installed. The traditional U.S. cabinet provides a cosmetically effective cabinet structure, but the construction of the face frames and their installation to the cabinet box typically consumes in excess of half of the construction time for the cabinet.

The usual European cabinet structure simply comprises a rectangular box void of the face frame found on the traditional U.S. cabinet structure. The sides and top of the box are flush with their exposed front edges. The cabinet doors are mounted to the exposed vertical edges of the box so that no portion of the cabinet box is viewed in the completed closed cabinet structure. This type of box construction lends itself to automation, since it totally eliminates the precise construction and fitting of separable face frames to the cabinet box. However, it is extremely difficult for an installer to install European cabinets since there is no excess room about the cabinet to accommodate wall or ceiling surface variations.

Accordingly, it is an object of the present invention to overcome these shortcomings of the prior art and to provide a cabinet construction which lends itself to automation during manufacture, yet is easy to install.

BRIEF DESCRIPTION OF THE DRAWINGS

Preferred embodiments of the invention are illustrated in the accompanying drawings, in which:

FIG. 1 is a perspective view of a prior art traditional U.S. cabinet structure;

FIG. 2 is a perspective view of a prior art European cabinet structure;

FIG. 3 is a perspective view of one embodiment of a cabinet constructed in accordance with the invention;

FIG. 4 is a section view taken along lines 4—4 in FIG. 3;

FIG. 13 is a perspective view illustrating materials used for constructing the storage cabinet of FIG. 7 in accordance with the invention; and FIG. 14 is a perspective view illustrating the materials used for constructing the storage cabinet of FIG. 9 in accordance with the invention.

DETAILED DESCRIPTION OF THE PREFERRED EMBODIMENT

Figure 5:
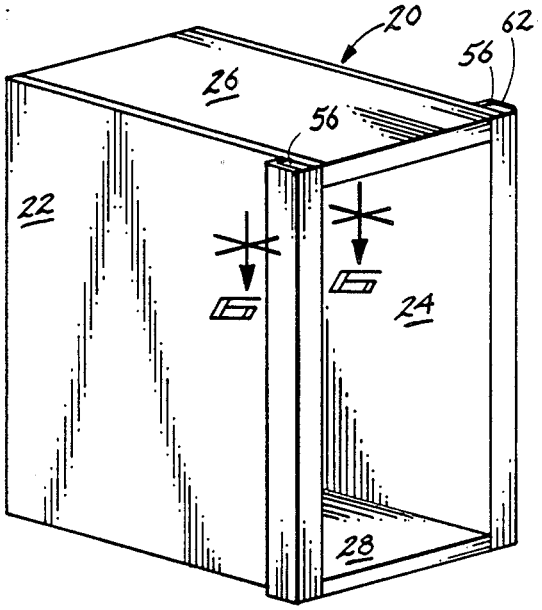
FIG. 5 is a perspective view of the cabinet as constructed in FIG. 4 employing decorative pieces of covering material to cover exposed seams.

The following disclosure of the invention is submitted in compliance with the constitutional purpose of the Patent Laws "to promote the progress of science and useful arts" (Article 1, Section 8).

A traditional U.S. cabinet structure 10, as shown in FIG. 1, is comprised of a box-like structure 12 and a separately manufactured face frame 14. Face frame 14 is secured to the end edges of box 12 and projects outwardly from the exterior surfaces of box 12. The face frame is commonly dadoed or rabbeted to provide a snug secure fit of frame 14 to box 12. The outwardly projecting face frame provides extra room between adjacent cabinets and the floor or ceiling adjacent which the cabinets are installed to enable adjustments of the cabinet to accommodate surface and corner variations.

A European storage cabinet 16, as shown in FIG. 2, is merely a box-like structure like the basic box-like structure 12 of the traditional U.S. cabinet 10. The front edges of the European cabinet are flush with the side surfaces, making their installation difficult as previously described.

Referring to FIGS. 3–6, one embodiment of a cabinet constructed in accordance with the invention is indicated generally by reference numeral 20. Storage cabinet 20 includes four interconnected rigid panel members forming a rectangular box-like cabinet structure constructed in a European type fashion. The box-like cabinet structure includes a spaced opposing pair of vertical side panels 22, 24 which are connected to a spaced opposing pair of upper and lower horizontal panels 26, 28, respectively. Cabinet structure 20 has a front opening 29 through which the cabinet is accessed. The rear end of cabinet 20 (not shown) can be provided with a vertical rear panel for sealing cabinet 20 at its back end. Alternately, when cabinet 20 is to be positioned flush against a wall, the rear vertical panel can be eliminated.

Vertical side panels 22, 24 each have an interior surface 32 and an exterior surface 34 bounded by front and panel edges 36, 38, respectively. Front and back edges 36, 38 extend between horizontally aligned top and bottom edges 40, 42, respectively, across each of the side panels 22 and 24. In a similar manner, upper and lower horizontal panels 26, 28 have an interior surface 44 and an exterior surface 46 bounded by front and back edges 48, 50, respectively. Front and back edges 48, 50 extend between vertically aligned side edges that abut the interior surfaces 32 of panels 22 and 24.

A front facing means is secured across the front edge of each vertical side panel and extends outwardly from each vertical side panel from its interior surface outwardly beyond its exterior surface. The front facing means serves to simulate the width and appearance of a manufactured face frame constructed separate from the cabinet structure, as would appear in the traditional U.S. cabinet.

Figure 6:
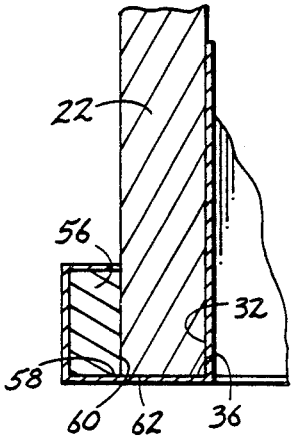
FIG. 6 is an enlarged section view taken along line 6—6 in FIG. 5.

More particularly, the front facing means is comprised of solid, rectangular strips 56 secured to the exterior surfaces 34 of each vertical panel 22, 24. As illustrated in FIG. 3, the strips include front edges 58 which are parallel to and flush with the front edges 36 of the vertical side panels to which they are secured, and extend between their top and bottom edges 40, 42. Also illustrated in FIG. 3, securing of a strip 56 to a vertical panel creates or presents a seam 60 between the vertical panel and secured strip. FIGS. 5 and 6 illustrate that this seam can be covered by a decorative covering sheet of material 62. Covering sheet 62 preferably extends across the front edges 58, 36 of each solid strip and vertical side panel, respectively, from the interior surface 32 of each vertical side panel. The purpose of covering sheet 62 is primarily one of aesthetics to cover connection seam 60. Cabinet hinges for supporting cabinet doors are preferably secured through covering 62 to front edge 36 of one of vertical panels 22 or 24.

As best illustrated in FIG. 3, cabinet 20 appears to have the width of a separately manufactured face frame which would be installed on a traditional U.S. cabinet last. Strips 56, by projecting outwardly beyond the exterior surfaces of the vertical side panels, will bear against the same strips of adjacent and similarly constructed cabinets, thereby providing space between adjacent cabinets for overcoming surface irregularities and producing an aesthetically appealing facing installation. A method for constructing such a cabinet, as will be more fully described below, enables the construction of cabinets at approximately ten times the rate with which traditional U.S. cabinets can be constructed.

Figure 7:
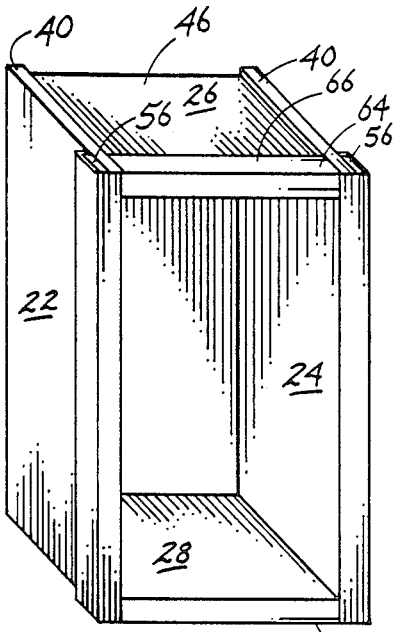
FIG. 7 is a front perspective view of a second embodiment of a cabinet structure constructed in accordance with the invention.
Figure 8:
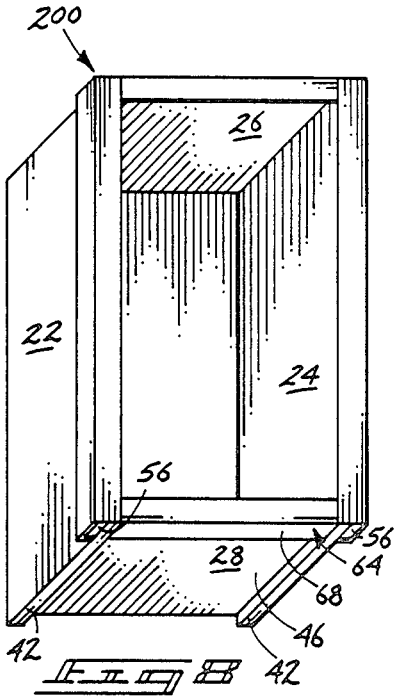
FIG. 8 is another front perspective view of the embodiment shown in FIG. 7.

FIGS. 7 and 8 illustrate another embodiment of a cabinet 200 constructed in accordance with the invention wherein another solid strip 64 is secured to the exterior surface 46 of each of horizontal panels 26, 28. more particularly as shown in FIG. 7, exterior surface 46 of upper horizontal panel 26 is recessed below the top edges 40 of vertical side panels 22, 24. Solid strip 64 has a horizontal upper surface 66 which is coplanar with the horizontally aligned top edges 40 of vertical side panels 22, 24. Additionally, as shown in FIG. 8, the exterior surface 46 of lower horizontal panel 28 is recessed above the bottom edges 42 of the vertical side panels 22, 24. The solid strip 64 secured to exterior surface 46 of lower horizontal panel 28 has a horizontal lower surface 68 which is coplanar with the horizontally aligned bottom edges 42 of the vertical side panels. Each of solid strips 64 has a front edge (not shown due to being covered by a covering sheet of material 62) which is parallel and flush to the front edge 48 of the horizontal panel to which it is secured.

The cabinet structure of FIGS. 7 and 8 again has an installed appearance similar to that of the embodiment shown in FIGS. 5 and 6. As before, vertical side strips 56 provide a means of accommodating surface irregularities in the back wall against which adjacent cabinets are to be positioned. The embodiment of FIGS. 7 and 8 has the additional advantage of enabling adjustment to accommodate surface irregularities present in a floor or ceiling against which adjacent cabinets so constructed are adapted to be installed. An installer is able to accommodate any irregularities because of the recess of the upper or lower horizontal panels 26, 28 from the upper and lowermost extent of the vertical side panels. To accommodate a surface irregularity present, for example, in a ceiling which would require the cabinet of FIG. 7 to be rotated counterclockwise, an installer would merely remove an appropriate amount of material from the top edge 40 of right vertical side panel 24. Such removing of material can be accomplished by using a simple wood plane or sanding device. By removing a desired amount of material, the cabinet can be tilted upwardly to the right a desired amount. Were such a cabinet to be installed on the floor having a similar irregularity, material from one of the bottom edges 42 of the appropriate vertical side panel 22 or 24 can be removed to provide proper alignment of the cabinet with respect to an adjacently mounted cabinet. This enables the installer to install such cabinets to provide an aesthetically appealing front installation.

Figures 9, 10, 11, 12:
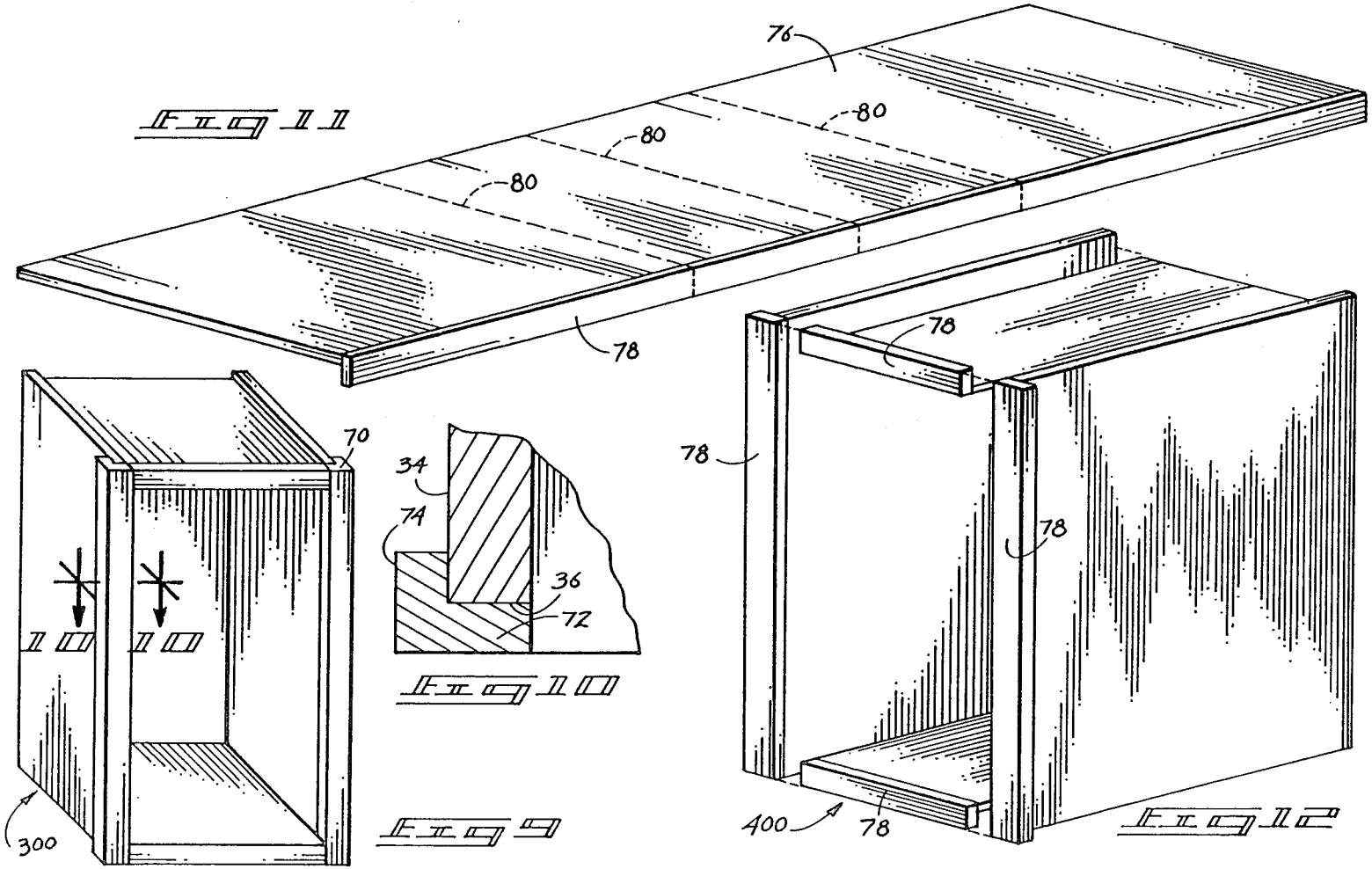
FIG. 9 is a front perspective view of yet another embodiment of a storage cabinet in accordance with the invention.
FIG. 10 is an enlarged section view taken along lines 10—10 in FIG. 9.
FIG. 11 is a perspective view of materials employed in a method for constructing a cabinet in accordance with the invention.
FIG. 12 is an exploded view of a storage cabinet constructed using the materials shown in FIG. 11.
Figure 10:
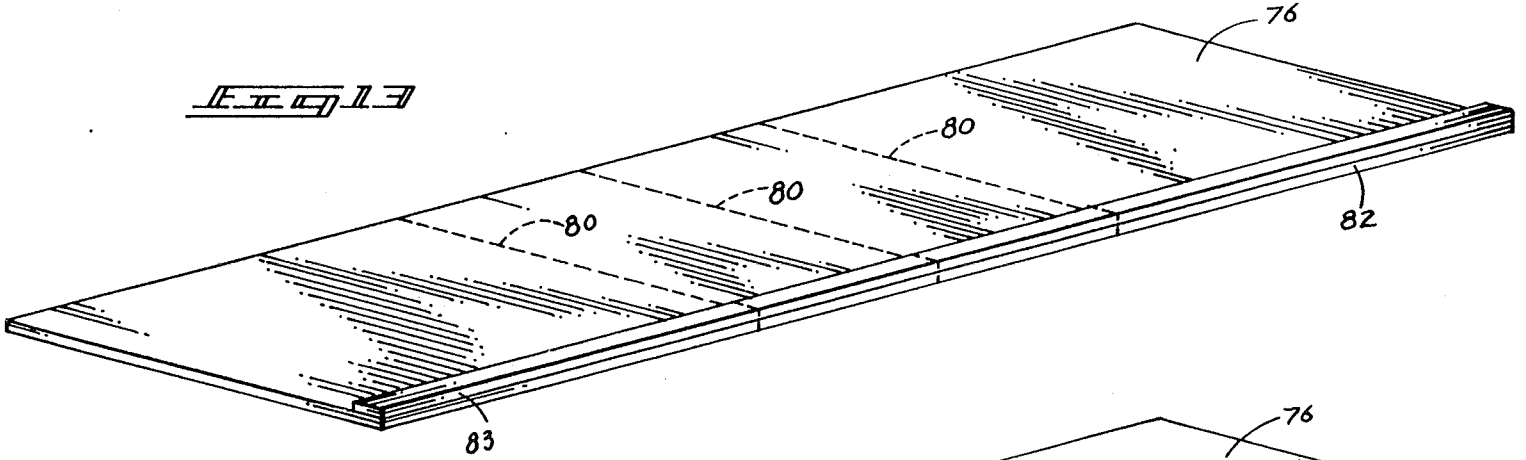
Figure 11:
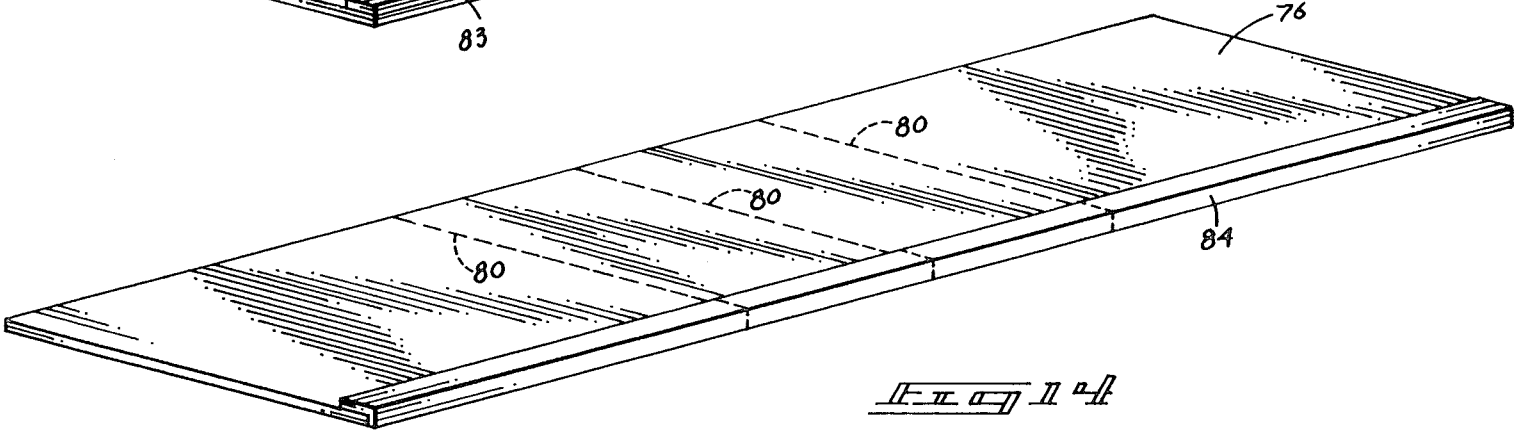

FIGS. 9 and 10 illustrate yet another embodiment of a cabinet 300 illustrating an alternate front facing means. Here, the front facing means is comprised of covering solid face strips 70 mounted across the front edge of each vertical panel and extending outwardly therefrom beyond each vertical panel exterior surface. Face strip 70, as shown, is generally L-shaped having a longitudinally extending portion 72 and a laterally extending portion 74. Laterally extending portion 74 is secured, for example by gluing, to exterior surface 34 or 46 of the vertical side or horizontal panel to which face strip 70 is secured. Longitudinal portion 72 is secured to the front edge 36 or 48 of the vertical side or horizontal panel on which face strip 70 is secured. With such a construction, a covering sheet of material is not required, as no exposed seam is created. Accordingly, strips 70 enable the cabinet to simulate the dimensions and appearance of a separately manufactured face frame positioned on the face of a cabinet constructed in a European fashion to simulate a traditional U.S. cabinet construction.

Yet another alternate embodiment of a cabinet construction 400 is shown in an exploded view in FIG. 12. Here, solid strips are secured solely to the front edges of the vertical side panels and upper and lower horizontal panels. In the previously described embodiments, the solid strip of material were secured either solely to the panel side surface or to the panel side surface and front edge. The embodiment of FIG. 12 is a less-preferred embodiment, as it is anticipated that a weak joint would be developed by solely securing the solid strip to the front edges.

A preferred method of constructing such cabinets is first described with reference to FIGS. 11 and 12. A first step is to provide an elongate sheet 76 and elongate solid strip 78, both of predetermined dimensions. Elongate sheet 76, when cut into pieces as described below, will form the panels of the box-like structure of the cabinet being constructed. Accordingly, sheet 76 is manufactured of any suitable cabinet material such as particleboard, plywood, or hardwood. Less expensive, nonsurface grade materials are generally used, as the panel portion of the cabinet is not visible from the front when installed. Elongate strip 78, for constructing the embodiment as shown in FIG. 12, is constructed of a surface grade, aesthetically pleasing material, as it will be exposed upon completion of construction, as shown in FIG. 12.

Elongate solid strip 78 is secured by gluing it along one edge of elongate sheet 76 such that it projects outwardly from a side surface of sheet 76 as shown. After allowing a sufficient amount of time for the glue to dry, sheet 76 is cut into a plurality of panels by cutting along dashed cut lines 80. The resulting panels will each have a portion of elongate strip 78 secured thereto and extending along one edge thereof. The panels are then assembled into a rectangular box-like structure with each portion of the elongate strip secured to each panel projecting outwardly beyond the exterior surface of the resulting box-like structure, as shown in FIG. 12.

FIG. 13 illustrates the layout of an elongate sheet 76 and associated strip 82 usable to construct the embodiment of the cabinet illustrated in FIG. 7. An elongate decorative piece of material (not shown) is preferably adhered across the one edge of elongate sheet 76 and secured solid strip 82 to cover a seam 83 presented between sheet 76 and secured strip 82 prior to cutting sheet 76 into panels.

FIG. 14 illustrates the layout of sheet 76 and an associated solid strip 84 usable to create the embodiment of the cabinet structure illustrated in FIG. 9. Lateral cuts are made across cut lines 80 and the four resulting panels constructed into the desired box-like cabinet structure The embodiment of FIG. 4 employs two panels (the upper and lower horizontal panels) not requiring a strip secured to their outer surfaces. Accordingly, a similar but alternate method for constructing such a cabinet could be employed by cutting a plurality of equally dimensioned panels from a sheet having a strip secured thereto to form the desired vertical panels of the cabinet structure. An assembler would merely use two of the panels as cut (and two other panels not having a strip secured thereto for creating the horizontal panels) in assembling the cabinet.

Cabinets constructed in such a manner can be manufactured and assembled much more rapidly than the traditional U.S. cabinet. For example, it would take approximately fifty (50) people eight (8) hours to make two-hundred fifty (250) traditional U.S. cabinet boxes. Using the method of the present invention, it takes only five (5) people eight (8) hours to make two-hundred fifty (250) cabinet boxes. Accordingly, man-hours are saved by a factor of about 10.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A storage cabinet void of a separately manufactured and installed face frame comprising:

four interconnected rigid panel members, the panel members being non-foldable and substantially nonmetallic, the interconnected panel members forming a rectangular box-like cabinet structure constructed in a European fashion without having a separately manufactured face frame installed apart from construction of the box-like structure, and including a spaced opposing pair of vertical side panels connected to a spaced opposing pair of upper and lower horizontal panels, the vertical side panels each having an interior surface and an exterior surface bounded by front and back edges that extend between horizontally aligned top and bottom edges; and front facing means secured across the front edge of each vertical side panel and extending from its interior surface outwardly beyond its exterior surface for simulating the width and appearance of a manufactured face frame constructed separate from the cabinet structure.

2. The storage cabinet of claim 1 wherein the front facing means comprises:

solid strips secured to the exterior surface of each vertical side panel, each strip extending between the top and bottom edges of a vertical side panel and having a front edge which is parallel to its front edges.

3. The storage cabinet of claim 2 wherein the solid strips are rectangular.

4. The storage cabinet of claim 1 wherein the front facing means comprises:

solid strips secured to the exterior surface of each vertical side panel, each strip extending between the top and bottom edges of a vertical side panel and having a front edge positioned parallel to its front edge, the front edge of each strip being flush with the front edge of the vertical side panel on which it is secured.

5. The storage cabinet of claim 1 wherein the front facing means comprises:

solid strips secured to the exterior surface of each vertical side panel, each strip extending between the top and bottom edges of a vertical side panel and having a front edge which is parallel to its front edge, the front edge of each strip being flush with the front edge of the vertical side panel on which it is secured; and a covering sheet of material extending from the interior surface of each vertical side panel across the front edges of each of the solid strips and vertical side panels.

6. The storage cabinet of claim 1 wherein the front facing means comprises:

a covering solid face member mounted across the front edge of each vertical side panel and extending outwardly therefrom beyond its exterior surface.

7. The storage cabinet of claim 1 wherein, each of the upper and lower horizontal panels has an interior surface and an exterior surface bounded by front and back edges that extend between vertically aligned side edges;

wherein the front facing means comprises:

a solid strip secured to the exterior surface of the upper horizontal panel, the solid strip having a front edge parallel to the upper horizontal panel front edge and extending between its side edges.

8. The storage cabinet of claim 1 wherein, each of the upper and lower horizontal panels has an interior surface and an exterior surface bounded by front and back edges that extend between vertically aligned side edges;

a solid strip secured to the exterior surface of each of the upper and lower horizontal panels, each of said solid strips secured to the upper and lower horizontal panels having a front edge parallel to the respective horizontal panel front edge and extending between the respective horizontal panel vertically aligned side edges.

9. The storage cabinet of claim 7 wherein, the exterior surface of the upper horizontal panel is recessed below the top edges of the vertical side panels; and the solid strip secured to the upper horizontal panel having a horizontal upper surface coplanar with the horizontally aligned top edges of the vertical side panels.

10. The storage cabinet of claim 1 wherein the front facing means comprises:

a solid strip secured to each of the vertical side panels, the solid strip having a longitudinally extending portion and a laterally extending portion, one of the laterally or longitudinally extending portions of each solid strip being secured to the exterior surface of one of the vertical side panels, the other of the longitudinal or laterally extending portion of each solid strip being secured to the front edge of the one vertical side panel on which the strip is secured.

11. A storage cabinet void of a separately manufactured and installed face frame comprising:

four interconnected rigid panel members, the panel members being non-foldable and substantially non-metallic, the interconnected panel members forming a rectangular box-like cabinet structure constructed in a European fashion without having a separately manufactured face frame installed apart from construction of the box-like structure, and including a spaced opposing pair of vertical side panels connected to a spaced opposing pair of upper and lower horizontal panels, the vertical side panels each having an interior surface and an exterior surface bounded by front and back edges that extend between horizontally aligned top and bottom edges, the upper and lower horizontal panels each having an interior surface and an exterior surface bounded by front and back edges that extend between vertically aligned side edges;

the exterior surface of the upper horizontal panel being elevationally recessed below the top edges of the vertical side panels; and front facing means secured across the front edge of each vertical side panel and the upper horizontal panel, and extending from each of the respective vertical and upper horizontal panel interior surfaces to a location located outwardly beyond the exterior surface of the vertical side panel to which it is secured, for simulating the dimensions and appearance of a manufactured face frame constructed separate from the cabinet structure.

12. The storage cabinet of claim 11 wherein the exterior surface of the lower horizontal panel is recessed elevationally above the bottom edges of the respective vertical side panels; and the front facing means is also secured across the front edge of the lower horizontal panel and extends from its interior surface outwardly beyond its exterior surface.

13. The storage cabinet of claim 11 wherein the front facing means comprises:

solid strips secured to the exterior surface of each vertical side panel and to the upper horizontal panel, each strip extending between the top and bottom edges or the side edges of the respective vertical side panels or upper horizontal panel and having a front edge positioned parallel to and flush with the vertical side or upper horizontal panel front edge to which it is secured.

14. The cabinet construction of claim 13 wherein the front facing means further comprises:

covering sheets of material extending across the front edges of each of the solid strips from the interior surface of the respective panel to which it is secured.

15. The storage cabinet of claim 11 wherein the front facing means comprises:

elongate solid strips secured to each of the vertical side panels and to the upper horizontal panel, respectively, the solid strips each having a longitudinally extending portion and a laterally extending portion, one of the laterally or longitudinally extending portions of the strip being secured to the exterior surface of the vertical side panel or upper horizontal panel to which it is secured, the other of the laterally or longitudinally extending portions of each strip being secured to the front edge of the vertical side panel or upper horizontal panel to which it is secured.

16. A method of constructing a storage cabinet in a European fashion without separately manufacturing and installing a face frame, yet the cabinet having the appearance and utilitarian advantages of having a face frame secured thereto, the method comprising the following steps:

securing an elongate solid strip along one edge of an elongate sheet, the elongate sheet being rigid, non-foldable, and substantially non-metallic, the elongate strip projecting outwardly from one side surface of the sheet;

cutting the sheet into a plurality of panels, each panel having a portion of the elongate solid strip extending along one edge thereof, the elongate solid strip being secured to the elongate sheet prior to cutting the sheet into a plurality of panels, and assembling at least four of the panels into a rectangular box-like structure with each portion of the elongate strip secured to each panel projecting outwardly beyond the exterior surface of the resulting box-like structure.

17. The method of claim 16 wherein the step of securing the elongate solid strip along the one edge of the elongate sheet involves securing the elongate solid strip to the one side surface of the elongate sheet and positioning one edge of the solid strip flush with the one edge of the sheet.

18. The method of claim 17 further including the following step:

adhering a piece of decorative material across the one edge of the elongate sheet and secured solid strip to cover a seam presented between the sheet and the strip.

19. The method of claim 16 wherein the step of securing the elongate solid strip along the one edge of the elongate sheet involves securing said elongate solid strip directly to the one edge of the elongate sheet.

20. The method of claim 16 wherein the step of securing the elongate solid strip along the one edge of the elongate sheet involves securing the elongate solid strip to both the one side surface and directly to the one edge of the elongate sheet.

21. A method of constructing a storage cabinet in a European fashion without separately manufacturing and installing a face frame, yet the cabinet having the appearance and utilitarian advantages of having a face frame secured thereto, the method comprising the following steps:

securing an elongate solid strip along one edge of an elongate sheet, the elongate sheet being rigid, non-foldable, and substantially non-metallic, the elongate strip projecting outwardly from one side surface of the sheet;

cutting the sheet into a plurality of panels, the elongate solid strip being secured to the elongated sheet prior to cutting the sheet into a plurality of panels, at least two of the panels having a portion of the elongate solid strip extending along one edge thereof; and using the at least two panels having a portion the elongate solid strip extending along one edge thereof in assembling a rectangular box-like structure with each of the at least two panels comprising one of the vertical side portions of the rectangular box-like structure, each of the portions of the elongate solid strip on each of the at least two panels projecting outwardly beyond the exterior side surface of the resulting box-like structure.

* * * * *